US007281690B2

(12) United States Patent
Kelley

(10) Patent No.: US 7,281,690 B2
(45) Date of Patent: Oct. 16, 2007

(54) TRASH BAG SUPPORT

(76) Inventor: Timothy W. Kelley, 10703 Longmont, Houston, TX (US) 77042

( * ) Notice: Subject to any disclaimer, the term of this patent is extended or adjusted under 35 U.S.C. 154(b) by 216 days.

(21) Appl. No.: 11/137,010

(22) Filed: May 25, 2005

(65) Prior Publication Data

US 2006/0266893 A1 Nov. 30, 2006

(51) Int. Cl.
*A63B 55/04* (2006.01)

(52) U.S. Cl. ..... 248/97; 248/99; 248/100

(58) Field of Classification Search ..... 248/97–101; 294/1.1; 141/390, 391
See application file for complete search history.

(56) References Cited

U.S. PATENT DOCUMENTS

| | | | | | |
|---|---|---|---|---|---|
| 571,513 | A | | 11/1896 | Davidson | |
| 1,167,782 | A | | 1/1916 | Richards | |
| 1,212,305 | A | | 1/1917 | Worsell | |
| 2,140,995 | A | * | 12/1938 | Groom et al. | 248/97 |
| 4,470,627 | A | | 9/1984 | Caroll et al. | |
| 4,550,440 | A | | 10/1985 | Rico | |
| 4,572,559 | A | | 2/1986 | Gainey | |
| 4,629,233 | A | | 12/1986 | Pfisterer | |
| 4,659,045 | A | | 4/1987 | Flynn | |
| 4,896,853 | A | | 1/1990 | Nyzen | |
| 4,921,193 | A | * | 5/1990 | Benesch | 248/97 |
| 4,971,274 | A | | 11/1990 | Mitchell | |
| 5,031,948 | A | | 7/1991 | Groth et al. | |
| 5,065,965 | A | * | 11/1991 | Aulabaugh | 248/99 |
| 5,107,666 | A | | 4/1992 | Rahtican | |
| 5,209,442 | A | * | 5/1993 | Buck et al. | 248/99 |
| 5,395,147 | A | | 3/1995 | Brown et al. | |
| 5,498,046 | A | | 3/1996 | Ridley, Sr. et al. | |
| 5,593,117 | A | | 1/1997 | Alexander, III | |
| 5,597,145 | A | * | 1/1997 | Meyers et al. | 248/97 |
| 5,655,739 | A | | 8/1997 | Teh-Wah Goo | |
| 5,785,369 | A | | 7/1998 | Ridley, Sr. et al. | |
| 5,806,815 | A | | 9/1998 | Knutson | |
| 5,864,919 | A | * | 2/1999 | Pineda | 15/409 |
| 5,899,419 | A | | 5/1999 | Ross et al. | |
| 6,116,548 | A | * | 9/2000 | Oleson | 248/97 |
| 6,135,518 | A | | 10/2000 | Holthaus | |
| 6,237,973 | B1 | | 5/2001 | Dupont et al. | |
| 6,318,588 | B1 | | 11/2001 | Lichtenwalner | |
| 6,378,577 | B1 | | 4/2002 | Piner et al. | |
| 6,450,461 | B1 | | 9/2002 | Lohmann | |
| 6,612,379 | B1 | | 9/2003 | Timmons | |
| 6,708,742 | B2 | * | 3/2004 | Weathers et al. | 141/391 |
| 2002/0000501 | A1 | * | 1/2002 | Linder | 248/99 |
| 2005/0103952 | A1 | * | 5/2005 | Evans | 248/99 |
| 2006/0032991 | A1 | * | 2/2006 | Gaines | 248/97 |

FOREIGN PATENT DOCUMENTS

| | | |
|---|---|---|
| DE | 19806086 | 8/1999 |
| GB | 737747 | 9/1955 |
| GB | 2052 935 A | 2/1981 |

* cited by examiner

*Primary Examiner*—Korie Chan
(74) *Attorney, Agent, or Firm*—Browning Bushman P.C.

(57) ABSTRACT

A support 10 for a flexible trash bag 16 comprises a housing 12 having an open end 11, substantially planar first side 18 and second and third sides 20, 24. A pair of brackets 50, 94 on circumferentially opposing sides of the housing each have a cavity 51, 96 therein. A leg assembly for supporting the housing with the open end of the housing facing generally upward and the bag supported on the housing including at least one leg 52 selectively positionable within the receiving cavity in each of the pair of brackets 50, 94.

17 Claims, 2 Drawing Sheets

TRASH BAG SUPPORT

FIELD OF THE INVENTION

The present invention relates to a device for supporting a flexible trash bag of the type adapted for receiving leaves or other debris. More particularly, the invention relates to a trash bag support which allows leaves to be blown or raked laterally into the trash bag, and also allows the trash bag to be supported in a substantially vertical position so that debris may be released or dumped into the trash bag.

BACKGROUND OF THE INVENTION

People familiar with yard work have devised devices for over 100 years to assist in filling a flexible bag with leaves and other debris. U.S. Pat. No. 571,513 discloses an early version of a stand to assist in filling a bag with lawn debris. UK Patent 737747 discloses a complex device to assist in filling a bag with debris. Publication GB2052935 discloses yet another device for bagging waste matter.

U.S. Pat. No. 4,740,627 discloses a device which resembles a modified trash can for receiving the trash bag within the can. U.S. Pat. No. 4,550,440 discloses a rim for supporting a bag. U.S. Pat. No. 4,572,599 discloses a device intended to serve as a scoop for raking leaves into a trashcan. U.S. Pat. No. 4,679,233 discloses another device intended to act as a funnel to receive and direct leaves into the bag. In one embodiment, a device is provided with legs. U.S. Pat. No. 4,971,274 discloses a complex device for assisting in filling a trash bag with debris. FIG. 5 discloses an embodiment wherein the device is intended to be supported on a wall.

U.S. Pat. No. 5,107,666 discloses another device which performs a funnel function for raking leaves into a bag. U.S. Pat. No. 4,657,045 discloses a funnel device which has a generally D-shaped configuration. Still other embodiments disclosing similar devices are shown in U.S. Pat. Nos. 5,031,948, 5,498,046, 5,395,147, 5,593,117 and 5,785,369. U.S. Pat. Nos. 5,655,739 and 6,378,577 disclose modifications to the idea of a scoop-type device for assisting in collecting leaves in a bag. U.S. Pat. No. 6,318,588 discloses a modified trash can designed to be laid down on its side to rake leaves into the bag. U.S. Pat. No. 6,237,973 discloses a funnel-type device which is fairly complex.

Other devices have been devised which seek to support a trash bag in a substantially vertical position to fill the bag with leaves. U.S. Pat. No. 4,896,853 discloses a mechanism for supporting a bag, and U.S. Pat. No. 6,135,518 discloses a receptacle for receiving legs of a throat member. U.S. Pat. No. 5,899,419 discloses a complex device for supporting a bag in a substantially vertical position, and U.S. Pat. No. 5,806,815 discloses a bracing assembly for supporting a bag. U.S. Pat. No. 6,450,461 discloses an alternative device for supporting a bag.

The disadvantages of the prior art involve the complexity and thus the cost of manufacturing the devices. Also, most devices cannot practically be used to either fill a bag in a lateral position, or support the bag for dumping debris into the top of the bag.

The disadvantages of the prior art are overcome by the present invention, and an improved support for a trash bag is hereinafter disclosed.

SUMMARY OF THE INVENTION

In one embodiment, a support for a flexible trash bag includes a housing having an open end for positioning within an open end of the trash bag. The housing includes a substantially planar first side for serving as a floor, and second and third sides each adjoining and substantially perpendicular to the first side. A pair of brackets are provided on opposing sides of the housing, with each bracket having a portion selectively attachable to the housing. Each of the pair of brackets also has a receiving cavity therein. A leg assembly is provided for supporting the housing with the open end of the housing facing substantially upward, the sides of the housing positioned within the bag, and the bag supported on the housing. Two legs of the assembly may be selectively positionable within a respective receiving cavity to support the housing on the floor or ground surface.

In one embodiment, the support includes a housing and a pair of brackets each having a male member and a female member, with the male member having a dovetail configuration. Each of the pair of brackets is adapted to selectively receive a portion of the bag between the male and female members of a respective bracket. In another embodiment, each bracket includes a male member selectively engageable with a slot in the housing.

In yet another embodiment, the support includes a housing and a pair of brackets on circumferentially opposing sides of the housing. A leg assembly is provided for mounting the housing with the open end of the housing facing generally upward. At least one leg of the leg assembly selectively engages each bracket to support the housing and thereby support the trash bag.

These and further features and advantages of the present invention will become apparent from the following detailed description, wherein reference is made to the figures in the accompanying drawings.

DESCRIPTION OF THE PREFERRED EMBODIMENTS

Figure 1:
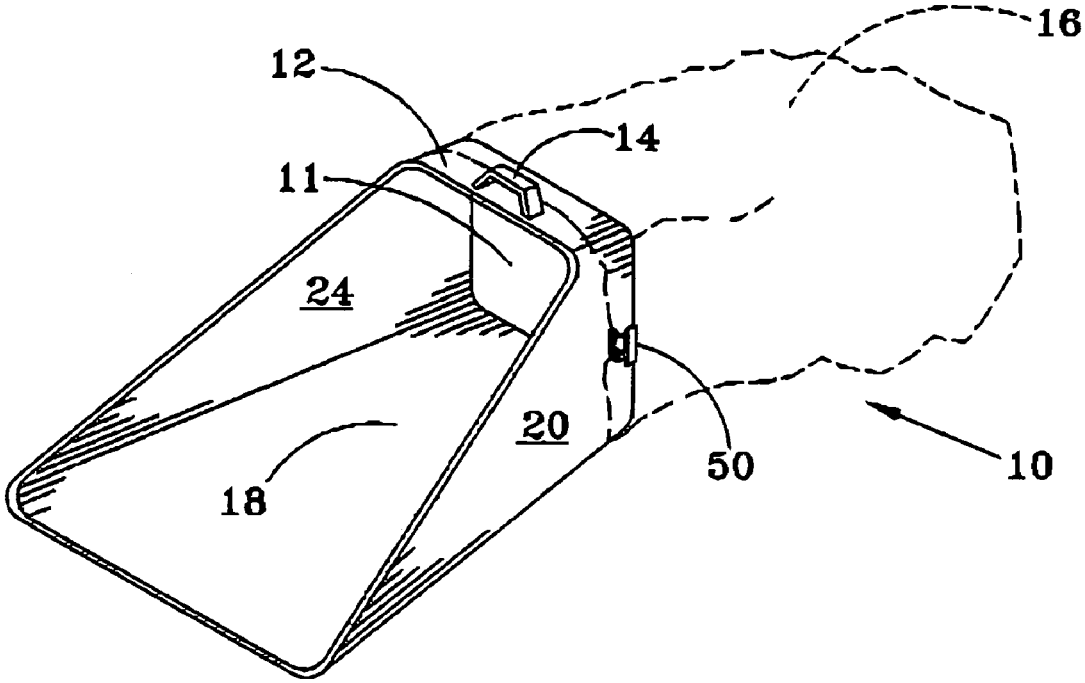
FIG. 1 is a pictorial view of the housing according to the present invention positioned for laterally receiving debris in a flexible bag which is shown in dashed lines.

FIG. 1 illustrates a suitable embodiment of a support 10 for a flexible trash bag when receiving leaves or other debris. Support 10 comprises a housing 12 defining a large through opening 11 therein, with the housing being configured such that a conventional flexible trash bag 16 may be positioned over the exterior surface of the housing 12. The housing comprises a substantially planar first side 18 serving as a floor when the first side is positioned on a ground surface for laterally receiving debris on the first side 18, and substantially identical second side 20 and a third side 24 each adjoining the first side and being substantially perpendicular to the first side. As shown in FIG. 1, the width of the first side 18 may increase in a direction away from the open end 11 in the housing, so that the housing acts in the manner of a funnel when raking or blowing debris through the housing 12 and into the bag 16. The second 20 and third 24 sides of the housing may have a substantially triangular configuration, with a reduced width opposite the open end of the housing and an enlarged width adjacent the open end of the housing. In a preferred embodiment, the housing 12, including the first side, the second side, and the third side, are each formed from a plastic material to provide a substantially unitary structure. A handle 14 may be is attached to the housing 12 opposite to side 18.

Figure 2:
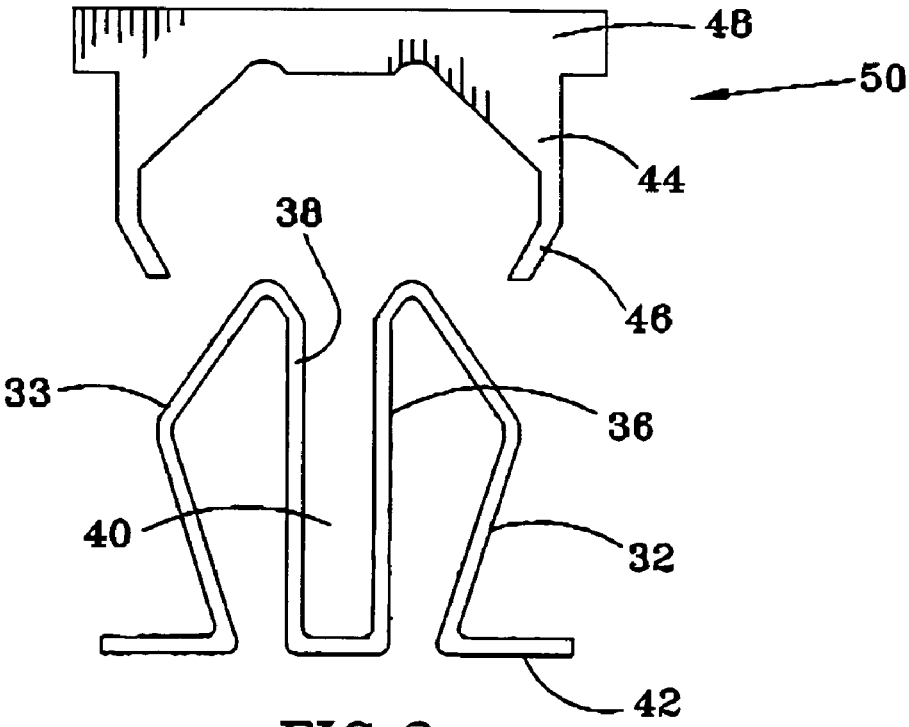
FIG. 2 illustrates a top view of a male bracket for securing to the side of the housing, and a mating female bracket spaced from engagement with the male bracket.

One of the brackets 50 generally shown in FIG. 1 is shown more clearly in FIG. 2. A pair of brackets 50 are provided on circumferentially opposing surfaces of the housing, with each bracket having one of a male member and a female member positioned on the housing and serving as a housing support member, and the mating one of the male member and a female member selectively attachable to a respective housing support member. For the embodiment as shown in FIG. 2, a lower surface 42 of the male member 32 may be formed as one piece with the housing 12, or could be welded or otherwise secured to the housing 12. A pair of spaced members 36, 38 with a gap 40 therebetween provide the desired flexibility to allow a female member 44 to be snapped into place, with the inward projecting tabs 46 on the female member 44 compressing the outer members 33 of a male member 32 toward each other. Body 48 of the female member 44 serves as a convenient handle when snapping on or pulling off the female member 48, and also a handle for manually moving the housing and optionally the bag 16 when the female member is secured to the male member.

Figure 3:
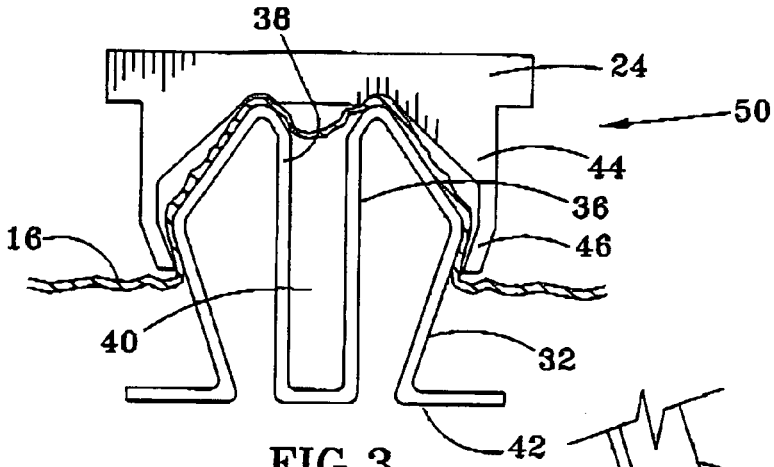
FIG. 3 illustrates the male bracket and a female bracket as shown in FIG. 2 engaged, with a portion of the flexible bag sandwiched between the brackets.

FIG. 3 illustrates the male member 32 positioned within the female member 44, with the upper end of the bag 16 positioned and held between the male member and the female member. The pair of circumferentially opposing brackets 50 temporarily connect the bag 16 to the housing 12. The main body 24 of the female member 44 thus serves as a handle, so that one can move the bag 16 and housing 12 easily around a yard.

Figure 4:
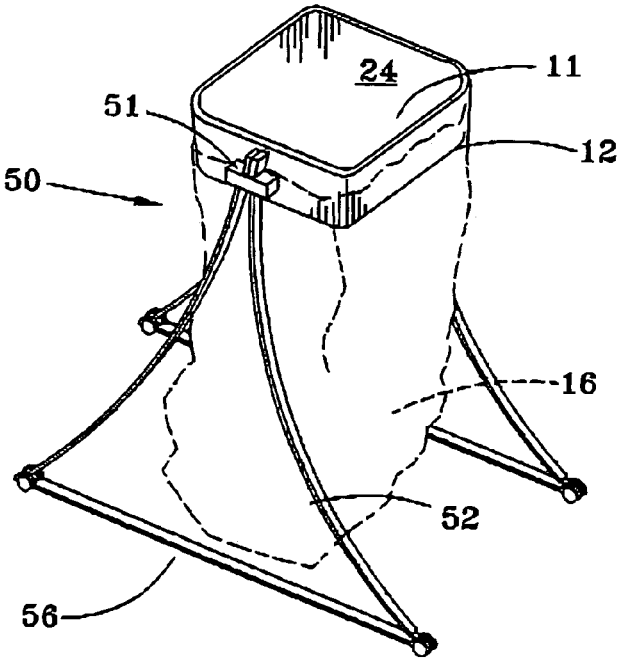
FIG. 4 illustrates a leg assembly supporting the housing with the housing mouth facing generally upward.

A leg assembly as shown in FIG. 4 comprising four substantially vertical support legs 52 and two base members 56 may support the housing 12, so that trash bag 16 supported over the sides of the housing may receive leaves therein. A pair of bent or bowed legs 52 are sized so that their upper ends may be received within the cavities 51 to support the housing 12 and the bag 16. Each of the pair of brackets 50 having a receiving cavity or slot 51 therein (see FIG. 4), and the slots of the male member and female member, when aligned, provide spacing for snugly receiving the upper ends of the leg members 52 therein.

As shown in FIG. 4, the receiving slots 51 comprise aligned substantially vertical slots in members 42 and 44. Both bracket assemblies thus preferably have a slot or receiving cavity in the same orientation as opening 11. Both accept the paired legs in the identical way. As shown in FIG. 3, at least one of the male member and the female member has a dovetail configuration, and a portion of the bag 16 may be positioned between the male and the female members of a respective bracket when engaged. In a preferred embodiment, the male member is the housing support member, and the female member may serve as a handle when moving the housing 12 about the yard. In this embodiment, the receiving cavity 51 in the bracket preferably is provided between the male member and the female member, and the leg support assembly includes four inclined (bent) legs 52, and two ground engaging or base members 56. The leg support assembly supports the housing such that a lower end of the bag is closely adjacent the ground surface, and thus the legs need not support the weight of the leaves or other lawn debris dumped into the bag 16. As shown in FIG. 4, the sides 18, 20 and 24 are positioned within the bag 16 when the housing 12 is supported on the legs 52. In an alternate embodiment, the sides 18, 20 and 24 may project upwardly from the housing 12 supported on the legs 52. The sides 18, 20 and 24 thus need not be placed in the bag 16, and act to deflect dumped leaves into the bag.

Figure 5:
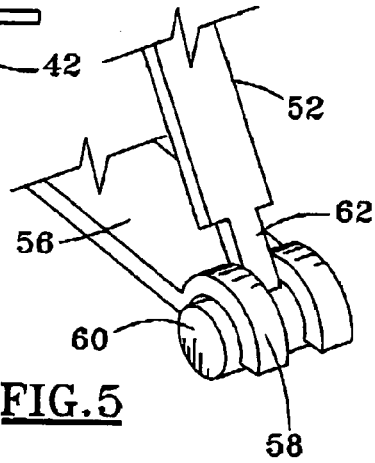
FIG. 5 illustrates a suitable corner portion of an upwardly projecting leg member and an end of a base member.

FIG. 5 illustrates a suitable interconnection between a lower end of one of the legs 52 and an end of the base member 56. The end of the base member 56 includes two curved downwardly extending fingers 58 with a slot between the fingers sized to receive narrow portion 62 of a leg 52. A cylinder 62 secured to the end of portion 62 thus fits under the fingers 58 to limit movement between legs 52 and base members 56 when positioned as shown in FIG. 4. The extending fingers 58 are long enough to allow the cylinder 60 to rotate almost 360° without disengaging. When not in use, the legs and base may nest against one another forming a flattened "Z" pattern.

Figure 6:
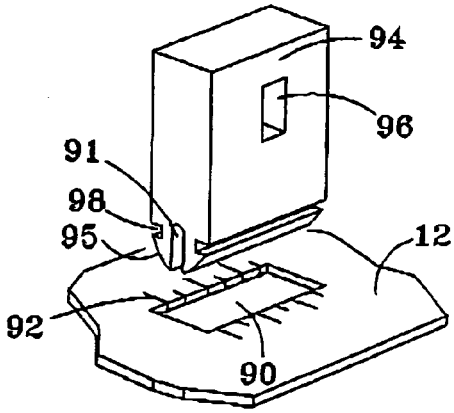
FIG. 6 illustrates an alternative bracket for selectively engaging the housing and sandwiching the bag.

FIG. 6 discloses an alternate bracket 94 comprising a male member for snapping into a rectangular slot 90 in housing 12. Lateral grooves 98 thus snap into the wall of the housing 12, which may be reinforced in the area adjacent the slot 96. Vertical cuts 92 in housing 12 provide flexibility to snap the member 94 in place and allow its removal. The engaging end 95 of bracket 94 may be rounded to facilitate the connection, and a slot 91 optionally provided in the engaging end of bracket 94. Cavity 96 is sized to receive the upper ends of two legs 52 when positioned as shown in FIG. 4. The trash bag is positioned between bracket 94 and housing 12.

In alternate embodiments, a single upper portion of a leg could engage the bracket, and the other leg on that side of the support could then be connected to the leg connected to the bracket. Additional legs may also be provided, if desired. A lateral member could be provided for maintaining a lateral spacing between two base members 56. Various mechanisms may be provided for pivotally interconnecting a lower end of a leg with a ground engaging base member, and the embodiment shown in FIG. 5 illustrates one form of this connection. The base members 56 as shown herein are elongate members, and optionally may be similar in cross section to the construction of the legs 52. In other embodiments, more substantial ground engaging members may be provided for supporting the legs, and in other embodiments the base members could be eliminated and lower end of the legs configured for engaging the ground with a pointed end to prevent movement of the lower ends of the legs.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A support for a flexible trash bag when receiving leaves or other debris, the support comprising:

a housing having an open end for positioning within an open end of the trash bag;

a substantially planar first side of the housing serving as a floor when the first side is positioned on a ground surface for laterally receiving debris on the first side, and second and third sides each adjoining the first side and being substantially perpendicular to the first side;

a pair of brackets on circumferentially opposing surfaces of the housing, each bracket having at least a portion selectively attachable to the housing, the bracket having a receiving cavity therein, each of the pair of brackets being adapted to temporarily connect a portion of the bag to the housing; and a leg assembly for supporting the housing with the open end of the housing facing generally upward and the bag supported on the housing, at least one leg of the leg assembly being selectively positionable within the receiving cavity in each of the pair of brackets.

2. A support as defined in claim 1, further comprising:

each of the second and third sides of the housing have a substantially triangular configuration, with a reduced width opposite the open end of the housing and an enlarged width adjacent the open end of the housing.

3. A support as defined in claim 1, wherein the first side has a variable width extending from the open end of the housing, such that the width of the first side spaced from the housing is greater than a width of the first side adjacent the opening in the housing.

4. A support as defined in claim 1, wherein the housing, the first side, the second side, and the third side are each formed from a plastic material, and provide a substantially unitary structure.

5. A support as defined in claim 1, wherein each bracket includes at least one of a male member and a female member and the housing includes a mating female member or male member.

6. A support as defined in claim 1, wherein the bracket includes a male member selectively engageable with a slot in the housing.

7. A support as defined in claim 6, wherein the receiving cavity in the bracket is provided in the male member.

8. A support as defined in claim 1, wherein the leg assembly includes at least four legs and supports the housing such that a lower end of the bag is closely adjacent the ground surface.

9. A support for a flexible trash bag when receiving leaves or other debris, the support comprising:

a housing having an open end for positioning within an open end of the trash bag;

a substantially planar first side of the housing serving as a floor when the first side is positioned on a ground surface for laterally receiving debris on the first side, and second and third sides each adjoining the first side and being substantially perpendicular to the first side;

a pair of brackets on circumferentially opposing surfaces of the housing;

each bracket having one of (a) a male member and a female member supported on the housing and serving as a housing support member, and a mating one of a male member and a female member selectively attachable to a respective housing support member, and (b) a male member selectively engageable with a slot in the housing, and each pair of brackets having a receiving cavity therein;

each of the pair of brackets is adapted to receive a portion of the bag between the male and female members of a respective bracket, or between the male member and the housing; and a leg assembly for mounting the housing with the open end of the housing facing generally upward, at least one leg of the leg assembly selectively engaging each bracket to support the housing.

10. A support as defined in claim 9, wherein the receiving cavity in the bracket is provided in adjoining slots in the male member and the female member, or in the male member engageable with the slot in the housing.

11. A support as defined in claim 9, wherein the leg assembly includes a base member pivotally connected to a lower end of two legs each supporting the housing.

12. A support as defined in claim 9, wherein the leg assembly comprises two spaced base members and four legs, each leg connected to an end of a respective base member.

13. A support for a flexible trash bag when receiving leaves or other debris, the support comprising:

a housing having an open end for positioning within an open end of the trash bag;

a first side of the housing serving as a floor when the first side is positioned on a ground surface for laterally receiving debris on the first side, and second and third sides each adjoining the first side;

a pair of brackets on circumferentially opposing surfaces of the housing;

a leg assembly for mounting the housing with the open end of the housing facing generally upward, at least one leg of the leg assembly selectively engaging each bracket to support the housing; and the leg assembly includes a base member pivotally connected to a lower end of two legs each supporting the housing.

14. A support as defined in claim 13, wherein each of the pair of brackets is adapted to temporarily connect a portion of the bag to the housing.

15. A support as defined in claim 13, wherein each bracket includes at least one of a male member and a female member and the housing includes a mating female member or male member.

16. A support as defined in claim 13, wherein the bracket includes a male member selectively engageable with a slot in the housing.

17. A support as defined in claim 13, wherein the leg assembly comprises two spaced base members and four legs, each leg connected to an end of a respective base member.

* * * * *